US007848664B2

(12) United States Patent
Suenaga et al.

(10) Patent No.: US 7,848,664 B2
(45) Date of Patent: Dec. 7, 2010

(54) TONER SUPPLY DEVICE AND IMAGE FORMING APPARATUS

(75) Inventors: Takenori Suenaga, Hachioji (JP); Atsushi Fujita, Hamura (JP)

(73) Assignee: Konica Minolta Business Technologies, Inc. (JP)

( * ) Notice: Subject to any disclaimer, the term of this patent is extended or adjusted under 35 U.S.C. 154(b) by 451 days.

(21) Appl. No.: 12/046,333

(22) Filed: Mar. 11, 2008

(65) Prior Publication Data

US 2008/0304838 A1 Dec. 11, 2008

(30) Foreign Application Priority Data

Jun. 11, 2007 (JP) ..... 2007-153749

(51) Int. Cl.
*G03G 15/08* (2006.01)

(52) U.S. Cl. ..... 399/27; 399/258; 399/262; 222/DIG. 1

(58) Field of Classification Search ..... 399/27, 399/258, 262; 222/DIG. 1
See application file for complete search history.

(56) References Cited

U.S. PATENT DOCUMENTS 5,652,947 A * 7/1997 Izumizaki ..... 399/58
5,826,134 A * 10/1998 Hino et al. ..... 399/27
6,397,019 B1 * 5/2002 Kasuga ..... 399/27
7,013,096 B2 * 3/2006 Ozawa et al. ..... 399/58
7,043,171 B2 * 5/2006 Ogata ..... 399/61
7,103,291 B2 * 9/2006 Odani ..... 399/27
7,110,707 B2 * 9/2006 Nishitani ..... 399/258
7,653,334 B2 * 1/2010 Matsunai ..... 399/258
2004/0052538 A1 * 3/2004 Yugeta et al. ..... 399/27
2004/0067069 A1 * 4/2004 Ogata ..... 399/27
2007/0047977 A1 * 3/2007 Shimizu ..... 399/13
2007/0047981 A1 * 3/2007 Ishida ..... 399/27
2007/0177888 A1 * 8/2007 Ishida ..... 399/27

FOREIGN PATENT DOCUMENTS

JP 04-251879 9/1992
JP 10-133466 5/1998
JP 2005-148238 6/2005

* cited by examiner

*Primary Examiner*—David M Gray
*Assistant Examiner*—Francis Gray
(74) *Attorney, Agent, or Firm*—Squire, Sanders & Dempsey L.L.P.

(57) ABSTRACT

It is possible to estimate the quantity of toner remaining in the storage container by stopping the supply of toner from the storage container when the quantity of toner in the storage section is at a prescribed level, by starting the supply of toner after continuing to print as it is for a prescribed period of time, and by measuring the time taken for the quantity of toner to reach the prescribed level.

4 Claims, 4 Drawing Sheets

TONER SUPPLY DEVICE AND IMAGE FORMING APPARATUS

This application is based on Japanese Patent Application No. 2007-153749 filed on Jun. 11, 2007 in Japanese Patent Office, the entire content of which is hereby incorporated by reference.

BACKGROUND OF THE INVENTION

The present invention relates to toner supply devices and image forming apparatuses, and in particular, to toner supply devices that can estimate the remaining amount of toner in a storage container that stores the toner, and to image forming apparatuses provided with such toner supply devices.

In an image forming apparatus, the electrostatic latent image formed on a photoreceptor is developed into a toner image by a developing unit that has a two-component developer comprising a toner and a magnetic carrier. The developer in the developing unit is conveyed to the developing section, and the toner gets adhered to the electrostatic latent image due to the application of a development bias thereby forming a toner image. When the toner is consumed due to development, toner is supplied to the developing section of the developing unit by a toner conveying screw provided inside a toner storage section of the toner supply device. In addition, toner is supplied due to the rotation action of the toner storage container, and a necessary quantity of toner is supplied to the storage section.

When a sensor that is provided in the storage section and that detects the quantity of toner detects that the quantity of toner is less than a prescribed quantity, a detection signal is transmitted to the control section, and the toner is supplied from the storage container to the toner storage section.

However, regarding how much toner is remaining in the storage container, since the storage container is a consumable item, a sensor or others for detecting the remaining amount of toner is rarely provided in the storage container, and some other methods have been proposed.

For example, in Unexamined Japanese Patent Application Publication No. 2005-148238, a technology is described in which the storage container which rotates is mounted detachably to a developing unit, the number of revolutions of the storage container is counted, and the amount of toner remaining in the storage container is estimated based on that number of revolutions or the cumulative time of rotation of the storage container.

Further, in Unexamined Japanese Patent Application Publication No. H4-251879, a technology is described in which a fuse is provided in a toner cartridge, the fuse is cut when the power is on or the like after the toner cartridge is replaced, the value of the amount of remaining toner is initialized, and thereafter the amount of remaining toner is estimated by summing the toner dispensing time.

In addition, in Unexamined Japanese Patent Application Publication No. H10-133466, a technology is described in which the cumulative number of transferred pixels in the image forming section, or the cumulative time of driving the toner supply motor that supplies toner to the developing device is measured thereby estimating the amount of remaining toner.

However, in all the technologies described in the above patent documents, the measurement of the amount of remaining toner is started from the time when a new toner storage container is installed for the first time. Also, in the method disclosed in Unexamined Japanese Patent Application Publication No. 2005-148238, the amount of toner supplied per revolution of the storage container cannot be said to be always constant because of changes in the toner density due to the environmental temperature and humidity, and a large amount of error occurs. Further, generally, considering this error, a warning that the toner is exhausted is being displayed early. The user will be forced to waste if, in this manner, it is judged incorrectly that there is no toner although there is some toner still remaining in the storage container.

In addition, in case the toner gets exhausted on the way of continuous image formation, if there is no new storage container near the user, the user takes out the storage container being used currently, shakes it and installs it again in the machine and tires to start printing. In this case, if the user removes and reinstalls the storage container in mid-course, since an initial setting is made when the storage container is installed in the technology described in the above patent documents, there is a problem that the control section judges that the storage container is a new one in spite of the fact that the storage container is only partially filled and incorrectly detects.

These problems are being caused by the fact that the detection of the remaining amount of toner is being made with the presumption that a new storage container is installed every time.

The purpose of the present invention is to provide a toner supply device that estimates the amount of toner remaining in the storage container before the toner gets exhausted without presuming that the installed storage container is a new one, and to provide an image forming apparatus provided with such a toner supply device.

SUMMARY

The above purpose can be achieved using the structures described below.

1. A toner supply device which supplies a toner to a developing section, the toner supply device including:

a storage container which contains a toner for supply and which is mounted detachably in the toner supply device;

a storage section for storing the toner supplied from the storage container;

a toner conveyance section for conveying the toner in the storage section to the developing section;

a sensor for detecting a predetermined amount of the toner in the storage section; and a control section which measures time from when supply of the toner from the storage container starts till when the sensor detects that an amount of the toner in the storage section has reached the predetermined amount, and which estimates an amount of the toner remaining in the storage container based on the measured time.

2. An image forming apparatus having a developing section and a toner supply device for supplying a toner to the developing section, the toner supply device including:

a storage container which contains a toner for supply and which is mounted detachably in the toner supply device;

a storage section for storing the toner supplied from the storage container;

a toner conveyance section for conveying the toner in the storage section to the developing section;

a sensor for detecting a predetermined amount of the toner in the storage section; and a control section which measures time from when supply of the toner from the storage container starts till when the sensor detects that an amount of the toner in the storage section has reached the predetermined amount, and which estimates an amount of the toner remaining in the storage container based on the measured time.

DETAILED DESCRIPTION OF THE PREFERRED EMBODIMENT

A preferred embodiment of the present invention is described in the following. However, although the present invention is explained based on a preferred embodiment shown in the figures, the present invention is not limited to the preferred embodiment. Further, the assertive explanations in the preferred embodiment of the present invention indicate merely a best mode, and do not restrict the definition of terms or the technical scope of the present invention.

(Image Forming Apparatus)

Figure 1:
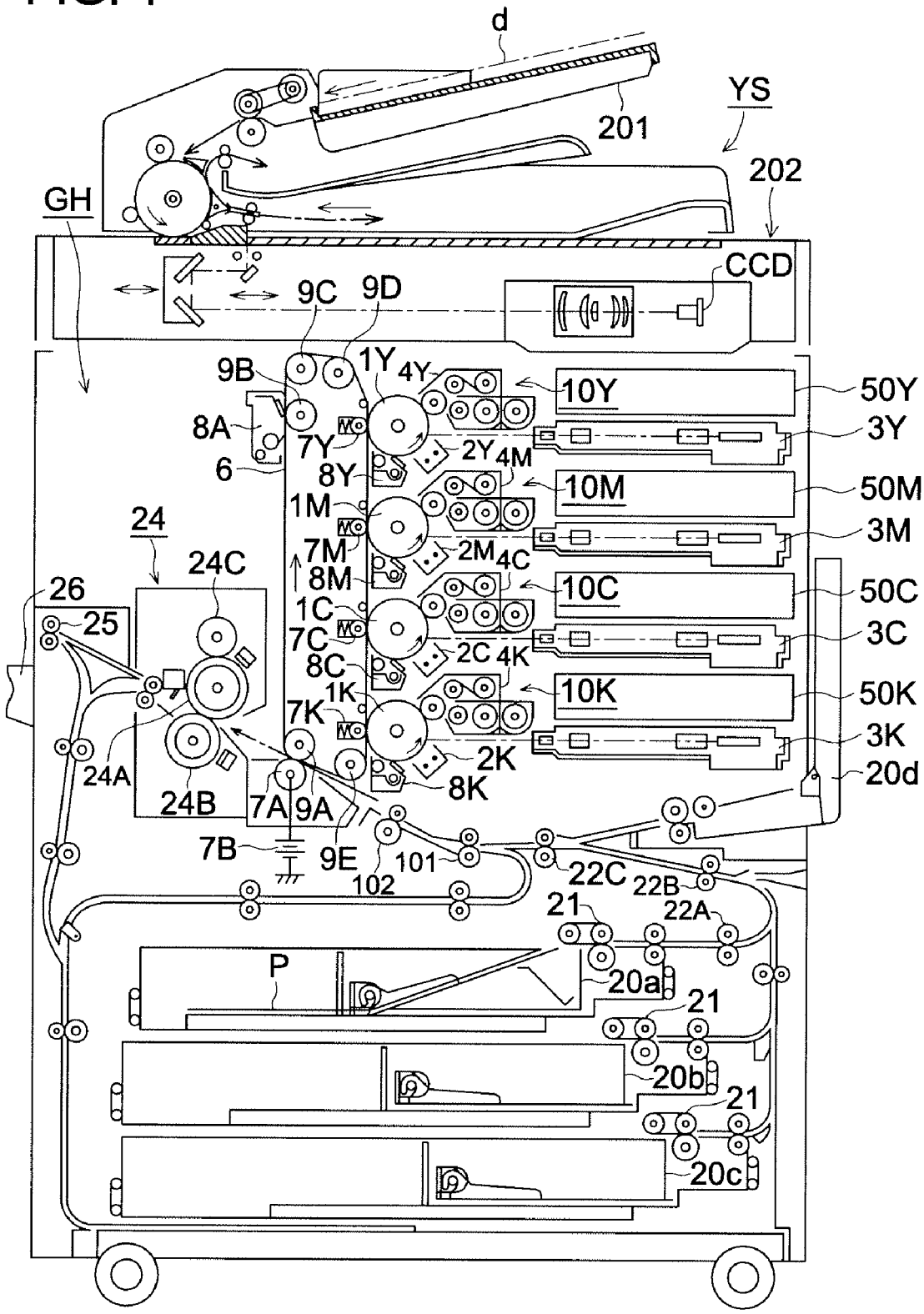
FIG. 1 is an overall configuration diagram of a color copying machine which is an example of an image forming apparatus.

FIG. 1 is a diagram showing the overall configuration of a color copying machine which is an example of an image forming apparatus according a preferred embodiment of the present invention that is constituted to include an image forming apparatus main unit GH and an image reading apparatus YS.

The image forming apparatus main unit GH is one that is a tandem type color image forming apparatus, and has plural sets of image forming sections 10Y, 10M, 10C, and 10K, a belt shaped intermediate image transfer member 6, a sheet feeding section, and a fixing unit 24.

The image forming section 10Y that forms images of yellow color has a charging unit 2Y, an exposure unit 3Y, a developing unit 4Y, and a cleaning unit 8Y, all placed surrounding a photoreceptor 1Y. The image forming section 10M that forms images of magenta color has a photoreceptor 1M, a charging unit 2M, an exposure unit 3M, a developing unit 4M, and a cleaning unit 8M. The image forming section 10C that forms images of cyan color has a photoreceptor 1C, a charging unit 2C, an exposure unit 3C, a developing unit 4C, and a cleaning unit 8C. The image forming section 10K that forms images of black color has a photoreceptor 1K, a charging unit 2K, an exposure unit 3K, a developing unit 4K, and a cleaning unit 8K. The charging unit 2Y and the exposure unit 3Y, the charging unit 2M and the exposure unit 3M, the charging unit 2C and the exposure unit 3C, the charging unit 2K and the exposure unit 3K, respectively constitute the latent image forming sections that form electrostatic latent images on the photoreceptors 1Y, 1M, 1C, and 1K, respectively.

The intermediate image transfer member 6 is wound around a drive roller 9A and the following rollers 9B to 9E, and moves in a circulatory manner in the direction of the arrow during image formation.

The single color toner images of different colors respectively formed by the image forming sections 10Y, 10M, 10C, and 10K are successively transferred onto the intermediate image transfer member 6 as primary image transfers by the image transfer rollers 7Y, 7M, 7C, and 7K, respectively, thereby forming a superimposed color toner image. The image forming sections 10Y, 10M, 10C, and 10K that form a color toner image on the intermediate image transfer member 6 and the image transfer rollers 7Y, 7M, 7C, and 7K constitute an image forming section.

A sheet P stored in one of a plurality of sheet feeding trays 20*a*, 20*b*, and 20*c* is fed from a sheet feeding section 21 having a feeding roller and a separating member, is passed through sheet feeding rollers 22A, 22B, and 22C and the registration roller 102 and others, and a color toner image is transferred onto the sheet P as a secondary image transfer from the transfer roller 7A due to the transfer voltage applied from the power supply 7B.

The sheet P on which a color toner image has been formed is separated from the intermediate image transfer member 6 by the drive roller 9A functioning as a separating member. The separating member is constituted by the drive roller 9A which is a small roller, and the sheet P is separated by curvature separation from the surface of the intermediate image transfer member 6 by pressing the intermediate image transfer member 6 using the drive roller 9A so that the intermediate image transfer member 6 is inflected to have a small radius curvature on its surface and by using the straight moving nature of paper.

Although numerals have not been assigned enough to the sheet feeding trays 20*b* and 20*c*, they have been provided with corresponding sheet feeding section 21 and conveying rollers 22A. The sheet conveying paths from the sheet feeding cassettes 20*a*, 20*b*, 20*c*, the manual sheet feeding tray 20*d*, and from the reverse conveying section for both surfaces all converge on the upstream side of the loop forming roller 101, and the sheet P is fed from a single sheet conveying path to the loop forming roller 101.

The sheet P on which a color toner image has been formed is fixed in the fixing unit 24, gripped by the sheet discharge roller 25, and is placed on the sheet discharge tray 26 outside the equipment. The fixing unit 24 is constituted to have top and bottom rollers 24A and 24B with heaters placed inside them, and a cleaning roller 24C, and the like.

On the other hand, a color toner image is transferred to the sheet P by the transfer roller 7A, and intermediate image transfer member 6 after being separated from the sheet P is cleaned by the cleaning unit 8A.

50Y, 50M, 50C, and 50K are the storage containers that supply fresh toner to the developing units 4Y, 4M, 4C, and 4K, respectively.

An image reading apparatus YS comprising an automatic document feeder 201 and an exposure unit 202 that exposes the document is placed above the image forming apparatus main unit GH. The document "d" placed on the document table of the automatic document feeder 201 is conveyed by the conveying rollers, and the images on one side or on both sides of the document are exposed in a scanning manner by the optical system of the exposing unit 202, and read out by a line image sensor CCD.

The analog signal obtained through photoelectric conversion by the line image sensor CCD, after being subjected to analog processing, A/D conversion, shading correction, image compression processing and others, in the image processing section, is input to the writing units 3Y, 3M, 3C, and 3K, respectively.

The automatic document feeder 201 is provided with a double sided document conveying section. Because the exposing unit 202 reads out successively the images of multiple numbers of sheets of the document fed from the document placement table and stores the images in a storage section (electronic RDH function), it is possible to copy the contents of a plural number of sheets of the document using the copying function, and also, it is possible to transmit the image data of a plural number of sheets of the document using the facsimile function.

(Toner Supply Device)

Figure 2:
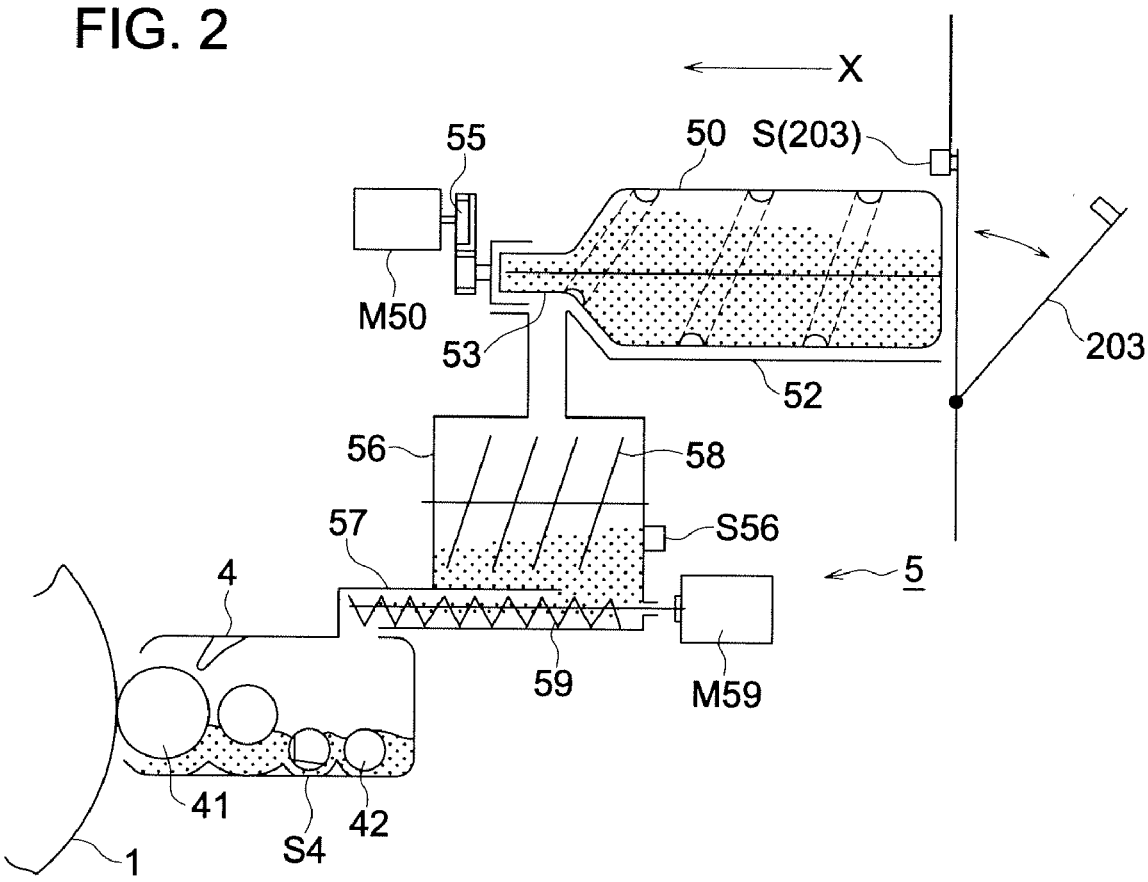
FIG. 2 is a projected diagram showing a broad outline of toner supply.

Next a toner supply device according to the present invention is described referring to FIG. 2. FIG. 2 shows a developing section 4, a developing device composed of a toner supply device 5, and a photoreceptor 1. The toner supply device 5 comprises a storage section 56 that stores the toner, a conveying section 57 that conveys the toner, and a storage container 50 that stores the toner.

The storage container 50 has a cylindrical shape with helical grooves provided on its outer periphery, and it can be attached to or detached from a container receiving section 52 provided in the developing unit. The toner is stored in the storage container 50, and when it is estimated that the toner is consumed and exhausted, it is removed form the container receiving section 52, and is replaced with a new one.

The storage container 50 has 460 g of toner inside it for each of the colors of yellow, magenta, and cyan, and 680 g of toner of black color. The storage container 50 has a toner discharging outlet 53 whose front end is coupled to a driving shaft (not shown in the figure) of the toner supply device body, and rotates receiving the driving force from a motor M50 via a gear wheel 55. A thrust force acts to convey the toner due to the helical groove (which projects from the inner wall of the container) provided on the storage container 50, the toner is conveyed in the direction of the arrow X, and is fed to the storage section 56 from the discharging outlet 53. As the details of the mechanism of discharging toner from the storage container 50, the mechanisms described in the Unexamined Japanese Patent Application Publication No. 2001-66870 or in the Unexamined Japanese Patent Application Publication No. 2001-183896 can be used.

Inside the storage section 56, stirring member 58 having stirring blades made of elastic thin plates that rotate along the inner wall is slowly rotating, thereby preventing the stored toner from adhering to the inner wall or from solidifying. In addition, a sensor S56 that detects the quantity of toner using a piezoelectric device is provided on the inner wall of the storage section 56. Even the detection section of the sensor S56 is rubbed on a timely basis by the stirring member 58, thereby preventing incorrect detection during the detection of the remaining quantity of toner. The detection position inside the storage section 56 of the sensor S56 is such that it detects a remaining toner quantity of 50 to 55 g as the predetermined quantity. This predetermined quantity of toner corresponds to about 3000 pages when printing is done with a blackening rate of 5.5% on A4 sized sheets.

A toner conveying section 57 having a toner conveying screw 59 that conveys the toner is provided near the bottom part of the storage section 56. The toner conveying screw 59 rotates due to the drive of the motor M59, and the toner from inside the storage section 56 is conveyed to the developing section 4 along the toner conveying section 57.

(Detection of Remaining Amount of Toner in Storage Container)

Next, the detection of the amount of toner remaining in the storage container 50 according to the present preferred embodiment is described referring to FIGS. 3 to 6.

Figure 3:
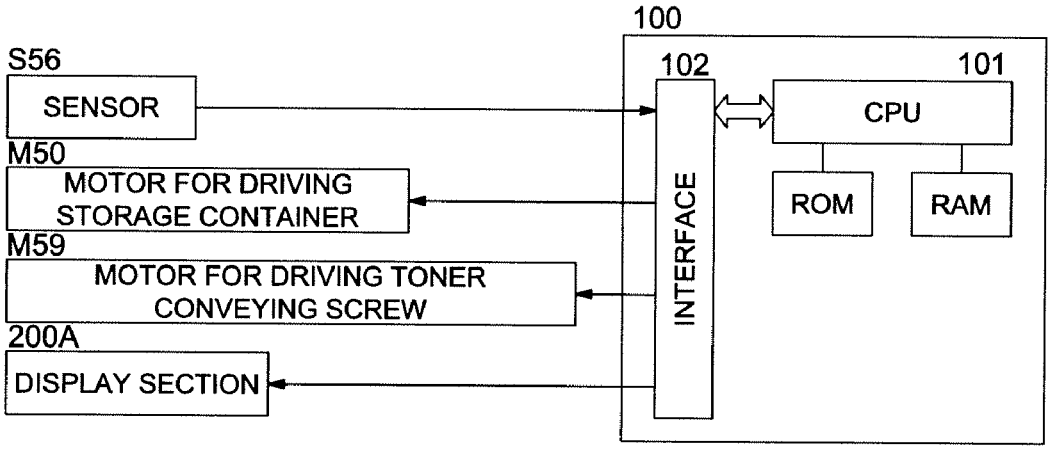
FIG. 3 is a block diagram showing the electrical system of toner supply.
Figure 4:
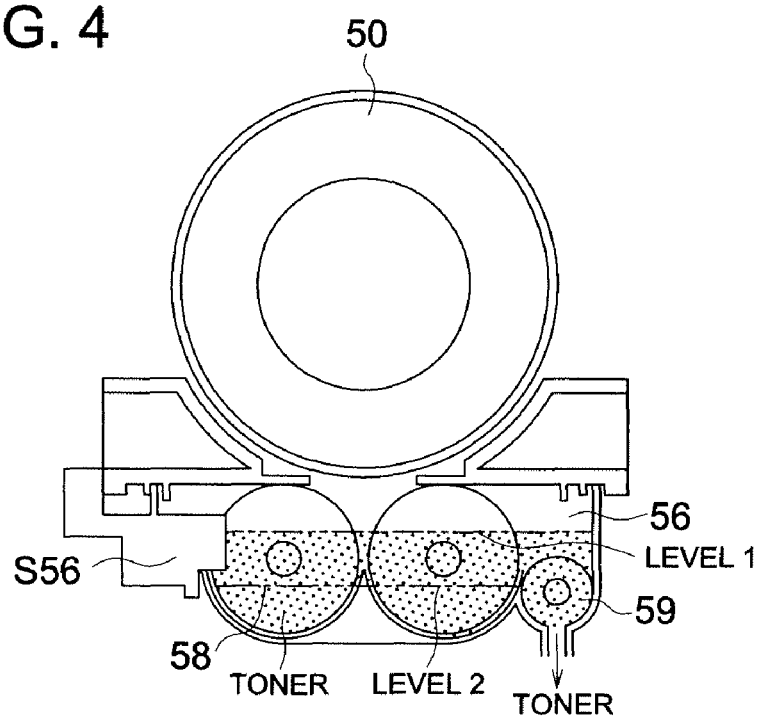
FIG. 4 is a cross-sectional view diagram showing the storage container and the storage section of a toner supply device.
Figure 6:
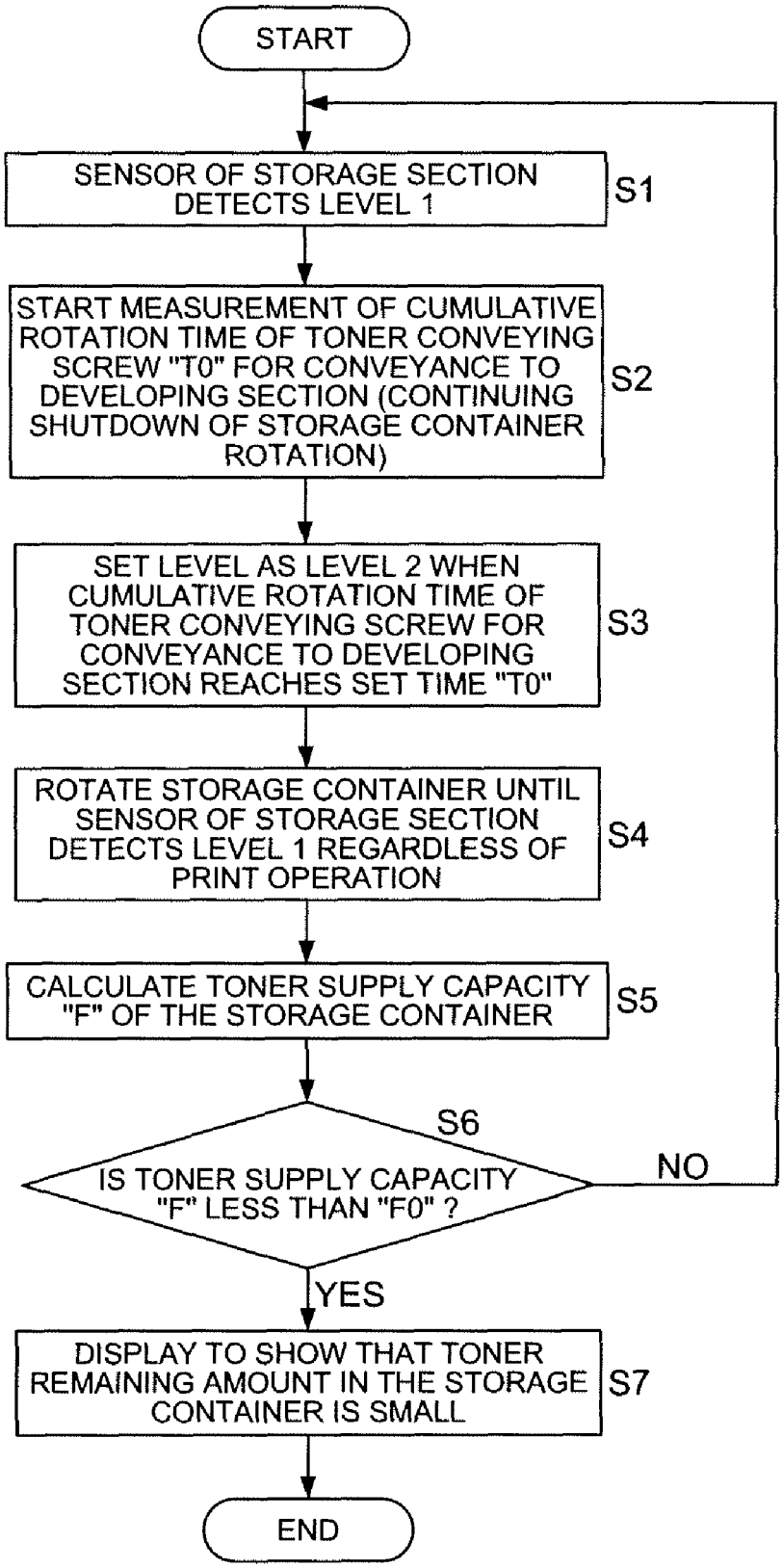
FIG. 6 is a control flow diagram of the control section that detects the amount of toner remaining in the storage container.

FIG. 3 is a block diagram showing the control of toner supply. FIG. 4 is a cross-sectional view diagram showing the storage container 50 and the storage section 56 of a toner supply device. FIG. 6 is a control flow diagram of the control section that detects the amount of toner remaining in the storage container 50.

In FIG. 3, the control section 100 is connected to the CPU 101 that carries out the arithmetic processing, the ROM that stores various operation programs, and the RAM that stores the measurement result data and others.

The flow of the control section 100 that estimates the quantity of remaining toner according to the present invention will be described as follows.

1) The control section 100 detects the prescribed quantity of toner with the sensor S56 in the storage section 56 when the toner is supplied from the storage container 50 to the storage section 56. When detecting the prescribed quantity of toner, the control section 100 starts to measure time from when the control section 100 detects the prescribed quantity of toner till when the cumulative time of rotation of the toner conveying screw 59 reaches a prescribed time period and the control section 100 stops supply of the toner from the storage container 50 to the storage section 56 (first toner supply stop control).

2) The control section 100 starts toner supply from the storage container 50 to the storage section 56 when the cumulative time of rotation has reached the prescribed time period.

3) The control section 100 counts the time period from the time of starting toner supply until the sensor S56 detects a prescribed quantity of toner.

4) The control section 100 stops the supply of toner from the storage container 50 to the storage section 56 at the instant of time when the sensor S56 detects a prescribed quantity of toner (second toner supply stop control).

5) The control section 100 estimates the quantity of toner remaining in the storage container 50 based on the measured time.

The CPU 101 is connected to external equipment via an interface 102. The sensor S56 that detects a prescribed quantity of toner in the storage section 56 and others is connected to the input side of the interface 102, and the drive motor M50 that rotates the toner storage container 50, the motor M59 that drives the toner conveying screw that conveys the toner inside the storage section 56, a display section 200A that are provided in the operation section of the main unit of the apparatus and that carry out display are connected to the output side of the interface 102.

In FIG. 4, Level 1 indicates the position of a prescribed quantity of toner detected by the sensor S56 when the toner is supplied from the storage container 50 to the storage section 56. Also, Level 2 indicates the position of the quantity of toner inside the storage section 56 when the cumulative time period of rotation of the toner conveying screw 59 has reached a prescribed time period.

Here, the time interval T0 required from toner quantity level 1 to level 2 is set in advance, and during that period, since the toner supply is not made due to the first toner supply stop control, toner is consumed for developing latent images, and the quantity of toner reduces with time.

Further, the control section 100 starts the toner supply from level 2, and when the sensor S56 detects again the position of level 1 which is the predetermined toner quantity, stops the second supply of toner. At this time, by measuring the time duration T1 that is required from starting toner supply until the second supply of toner is stopped, it is possible for the control section 100 to obtain the toner supply capacity per unit time F (g/hour) of the storage container 50.

In actuality, the quantity R of toner in the storage container at the time T1 obtained by experimental measurement, and the quantity supplied per unit time (the toner supply capacity F) is calculated, and this value is stored in the ROM inside the control section as a table.

Figure 5:
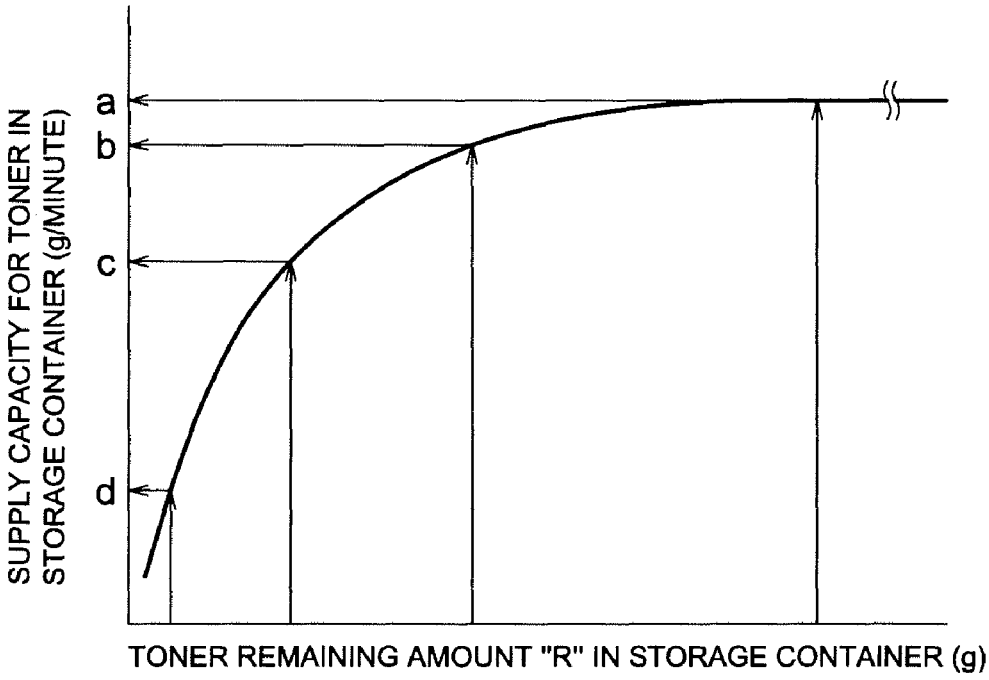
FIG. 5 is a graph showing the capacity of supplying the toner in the storage container versus the amount of toner remaining in the storage container.

FIG. 5 shows a curve plotted with the toner supply capacity F being along the vertical axis and the remaining quantity R of toner in the storage container being along the horizontal axis using the values of "F" and "R" obtained experimentally. This curve indicates that the toner supply capacity F is almost constant when sufficient toner is remaining in the storage container 50, and the toner supply capacity F gradually decreases as the remaining quantity R of the toner in the storage container 50 becomes smaller.

In this manner, in an image forming apparatus provided with a control of estimating the quantity of remaining toner and a toner supply device, the control section 100 enters the mode of estimating the remaining quantity of toner when, for example, the user presses a button (not shown in the figure) for checking the toner quantity, and starts the operation of measuring the time T1. If the toner supply capacity F calculated from time T1 is the value "a" of FIG. 5, it is judged that the quantity of toner inside the storage container is sufficient, and a statement such as "Toner is sufficient" is displayed in the display section 200A.

Further, if, for example, the toner supply capacity F is the value "b" or "c" of FIG. 5, a message such as "Toner amount has been small" or "Prepare a new toner storage container because a few % of toner is remaining" is displayed. Further, it is also possible to display a warning that the toner is exhausted when the value "d" of FIG. 5 is reached.

Next, the control of estimating the remaining quantity of toner is described here using the flow chart of FIG. 6.

The estimating of the quantity of toner remaining is done based on the flow from Step S1 to Step S7 of FIG. 6. In other words, the control section 100 rotates the storage container 50 using the drive from the motor M50, supplies toner to the storage section 56, and detects using the sensor S56 that the quantity of toner in the storage section 56 has reached the prescribed toner quantity Level 1 (Step S1).

At this time, based on a signal from the sensor S56, the rotation of the storage container 50 is stopped due to the first toner supply stop control (Step S2).

The control section 100 continues the image forming operations (JOB) from the instant of time when the rotation of the storage container 50 is stopped, and rotates the toner conveying screw 59 until the cumulative rotation period has reached a set predetermined cumulative rotation period T0. When the cumulative rotation period T0 is reached, the quantity of toner in the storage section 56 is taken as level 2 (Step S3).

The cumulative rotation period T0 is determined by obtaining experimentally when the quantity of toner supplied per unit time of the toner conveying screw 59 is constant.

Next, when the cumulative rotation time of the toner conveying screw 59 becomes T0, the drive motor M50 is driven again by the toner supply start control of the control section 100 thereby rotating the storage container 50 and supplying toner to the storage section 56.

While supplying toner to the storage section 56, the time until the sensor S56 detects Level 1 is measured (Step S4), and the time at that instant is taken as T1. When Level 1 is reached, the rotation of the storage container 50 is stopped by the second toner supply stop control.

The estimation of the remaining quantity of toner is done by judging whether the toner supply capacity F obtained based on the measured time T1 has decreased as compared to the toner supply capacity F0 when there is sufficient quantity R of toner remaining in the storage container 50 (F<F0) (Step S6). If F<F0 (YES in Step S6), referring to the table present in the control section 100, the quantity of toner remaining R is obtained from the value of "F" corresponding to the elapsed time. In addition, from the estimated result, the fact that the remaining quantity of toner in the storage container 50 is low is displayed in the display section 200A (Step S7).

When F=F0 (NO in Step S6), it is judged that there is sufficient toner in the storage container and the JOB is continued without change. In addition, it is also possible to display a message in the display section 200A that the toner quantity is sufficient.

By carrying out estimation of the quantity of remaining toner in this manner, it is possible, with an inexpensive configuration and without presuming that a new storage container is always installed, to give out definitely a message (warning) before the toner in the storage container gets exhausted.

In addition, even if the user detaches and attaches the toner storage container 50 in mid-course, for example, by providing an opening and closing switch to the toner supply door or the like, and making the control section 100 recognize the ON/OFF signal of the switch, and by carrying out estimation of the remaining quantity of toner, it is possible to solve the problem of judging that the storage container is a new one in spite of the fact that the storage container is only partially filled with toner.

According to the present invention, since there is a fixed relationship between the quantity of toner remaining in the storage container and the quantity of toner supplied from the storage container, and since it is possible to estimate the quantity of toner remaining by measuring the time taken for accumulating a fixed quantity of toner, it is possible to estimate the quantity of toner remaining in the storage container without presuming that the installed storage container is a new one.

What is claimed is:

1. A toner supply device which supplies a toner to a developing section, the toner supply device comprising:

a storage container which contains a toner for supply and which is mounted detachably in the toner supply device;

a storage section for storing the toner supplied from the storage container;

a toner conveyance section for conveying the toner in the storage section to the developing section;

a sensor for detecting a predetermined amount of the toner in the storage section; and a control section which measures time from when supply of the toner from the storage container starts till when the sensor detects that an amount of the toner in the storage section has reached the predetermined amount, and which estimates an amount of the toner remaining in the storage container based on the measured time.

2. The toner supply device of claim 1, further comprising, a table which represents a relation between an amount of the toner remaining in the storage container and time from when supply of the toner from the storage container starts till when the sensor detects the predetermined amount of the toner, wherein the control section refers to the table and estimates the amount of toner remaining in the storage container based on the measured time.

3. An image forming apparatus having a developing section and a toner supply device for supplying a toner to the developing section, the toner supply device comprising:

a storage container which contains a toner for supply and which is mounted detachably in the toner supply device;

a storage section for storing the toner supplied from the storage container;

a toner conveyance section for conveying the toner in the storage section to the developing section;

a sensor for detecting a predetermined amount of the toner in the storage section; and a control section which measures time from when supply of the toner from the storage container starts till when the sensor detects that an amount of the toner in the storage section has reached the predetermined amount, and which estimates an amount of the toner remaining in the storage container based on the measured time.

4. The image forming apparatus of claim 3, further comprising, a table which represents a relation between an amount of the toner remaining in the storage container and time from when supply of the toner from the storage container starts till when the sensor detects the predetermined amount of the toner, wherein the control section refers to the table and estimates the amount of toner remaining in the storage container based on the measured time.

* * * * *